US009156604B2

(12) United States Patent
Roila et al.

(10) Patent No.: US 9,156,604 B2
(45) Date of Patent: Oct. 13, 2015

(54) CIGARETTE PACKET

(75) Inventors: Patrizio Roila, San Mariano di Corciano (Perugia) (IT); Andrea Biondi, Bologna (IT)

(73) Assignee: G.D S.p.A. (IT)

( * ) Notice: Subject to any disclaimer, the term of this patent is extended or adjusted under 35 U.S.C. 154(b) by 261 days.

(21) Appl. No.: 13/884,548

(22) PCT Filed: Nov. 16, 2011

(86) PCT No.: PCT/IB2011/055131

§ 371 (c)(1),
(2), (4) Date: May 9, 2013

(87) PCT Pub. No.: WO2012/073141

PCT Pub. Date: Jun. 7, 2012

(65) Prior Publication Data

US 2013/0248392 A1 Sep. 26, 2013

(30) Foreign Application Priority Data

Nov. 29, 2010 (IT) ..... BO10A0709

(51) Int. Cl.

| | |
|---|---|
| ***B65D 85/10*** | (2006.01) |
| ***B65D 5/64*** | (2006.01) |
| ***B65D 5/66*** | (2006.01) |
| ***B65D 5/72*** | (2006.01) |
| ***A24F 15/12*** | (2006.01) |

(52) U.S. Cl.

CPC ..... *B65D 85/1045* (2013.01); *A24F 15/12* (2013.01); *B65D 5/646* (2013.01); *B65D 5/6685* (2013.01); *B65D 5/723* (2013.01); *B65D 85/1009* (2013.01)

(58) Field of Classification Search

CPC ..... B65D 85/12; B65D 85/1054; B65D 5/38; B65D 5/646; A24F 15/16; A24F 15/12

USPC ..... 206/249–255, 267, 271, 468, 817, 815; 229/125.125

See application file for complete search history.

(56) References Cited

U.S. PATENT DOCUMENTS 1,928,759 A * 10/1933 McQuillen ..... 206/250
1,965,049 A * 7/1934 Nahm ..... 206/259

(Continued)

FOREIGN PATENT DOCUMENTS

FR 1504134 12/1967

OTHER PUBLICATIONS

International Search Report and Written Opinion dated Feb. 23, 2012 from counterpart PCT application.

*Primary Examiner* — Mickey Yu
*Assistant Examiner* — Chun Cheung
(74) *Attorney, Agent, or Firm* — Timothy J. Klima; Shuttleworth & Ingersoll, PLC

(57) ABSTRACT

A cigarette packet substantially having the shape of a parallelepiped and containing a group of cigarettes includes an outer case formed by two larger lateral walls, respectively a front wall and a rear wall, and by two smaller lateral walls or sides, by a lower wall or base and by an upper wall or lid. An inner case is inserted in the outer case. The outer case includes a projection for controlling the lid, the projection being interposed between the front wall of the outer case and a front wall of the inner case and moveable between a first position in which the lid is closed and a second position in which the lid is open. A mechanism is provided for reciprocal engagement of the projection and the inner case for partially extracting the group of cigarettes from the outer case.

19 Claims, 11 Drawing Sheets

(56) References Cited

U.S. PATENT DOCUMENTS

| | | | | | |
|---|---|---|---|---|---|
| 1,977,888 | A | * | 10/1934 | Nahm et al. | 206/267 |
| 2,030,305 | A | * | 2/1936 | Koehler | 206/250 |
| 3,078,030 | A | | 2/1963 | Gorton | |
| 7,658,280 | B2 | * | 2/2010 | Bardet et al. | 206/267 |
| 7,726,473 | B2 | * | 6/2010 | Miyazawa et al. | 206/250 |
| 2009/0205982 | A1 | * | 8/2009 | Hein et al. | 206/251 |
| 2012/0261285 | A1 | * | 10/2012 | Holloway et al. | 206/250 |

* cited by examiner

CIGARETTE PACKET

This application is the National Phase of International Application PCT/182011/055131 filed Nov. 16, 2011 which designated the U.S. and that International Application was published under PCT Article 21(2) in English.

This application claims priority to Italian Patent Application No. BO2010A000709 filed Nov. 29, 2010, which application is incorporated by reference herein.

TECHNICAL FIELD

This invention relates to a cigarette packet.

This specification refers in particular to cigarette packets known as "hard packets".

BACKGROUND ART

Known in the prior art is, for example, a hard packet with a hinge lid (or flip top) made from a flat paperboard blank which is preweakened and precreased. The packet consists of a container open at one end and a lid hinged to an end edge of the container.

The packet also has an inner element or frame extending from the open end of the container which it is fixed to at a front wall and two lateral walls and whose function is to connect the container to the lid.

Once the packet has been opened, however, it tends to be difficult to keep the lid in the correct position, despite the presence of opposing elements at the corners of the inner frame to hold it in place.

This drawback causes loss of cigarette humidity and flavour.

DISCLOSURE OF THE INVENTION

The aim of this invention is to provide a cigarette packet which can overcome the above mentioned drawback, that is to say, a packet which combines the robustness of a hinge lid packet with the capability of remaining well sealed when closed.

The invention accordingly provides a cigarette packet comprising the features set out in the accompanying claims.

BRIEF DESCRIPTION OF THE DRAWINGS

The invention will now be described with reference to the accompanying drawings which illustrate a preferred embodiment of it and in which.

DETAILED DESCRIPTION OF THE PREFERRED EMBODIMENTS OF THE INVENTION

The numeral 1 denotes in its entirety a packet substantially in the shape of a parallelepiped with rectangular cross section and whose longitudinal axis is labelled A.

Figure 1:
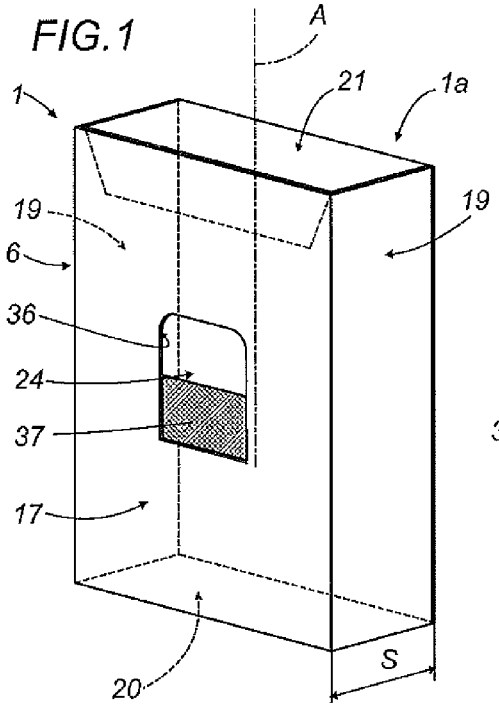
FIGS. 1, 2, 3 are perspective views of the packet according to the invention in three different configurations, namely, closed, half open and open, respectively.
Figure 2:
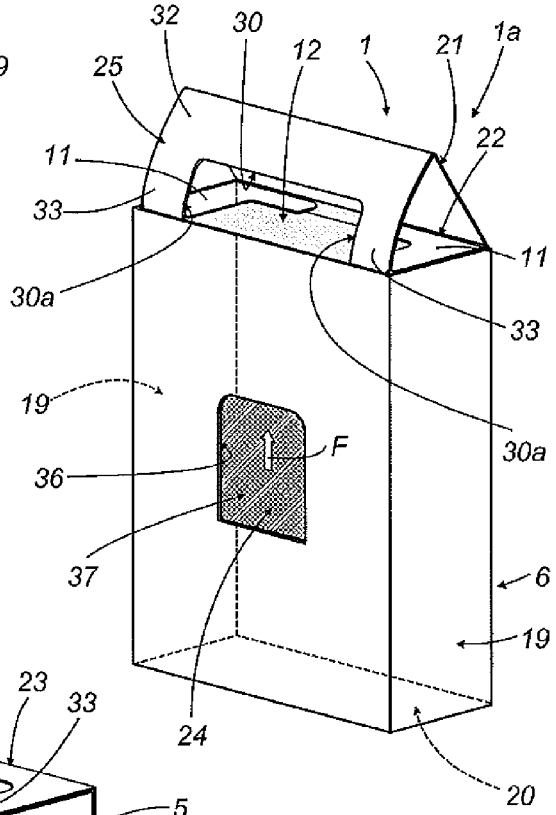
Figure 3:
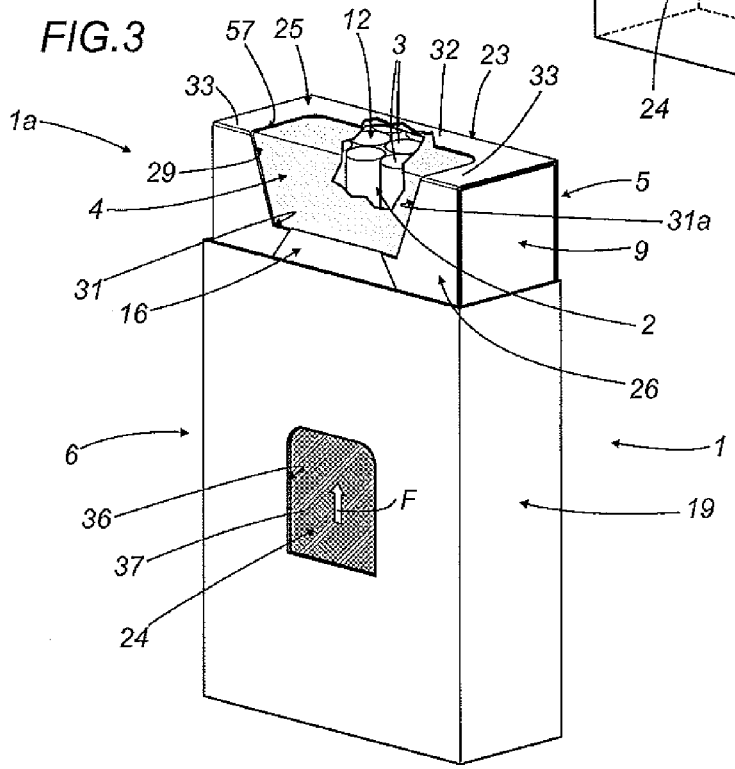

The packet 1, labelled 1*a* in a first embodiment of it illustrated in FIGS. 1, 2 and 3, contains a group 2—substantially in the shape of a parallelepiped, wrapped in a piece of foil 4—of cigarettes 3 arranged in three layers 3*a*, 3*b*, 3*c*, and comprises an inner case 5 and an outer case 6, both made of paperboard or similar semirigid material.

Figure 4:
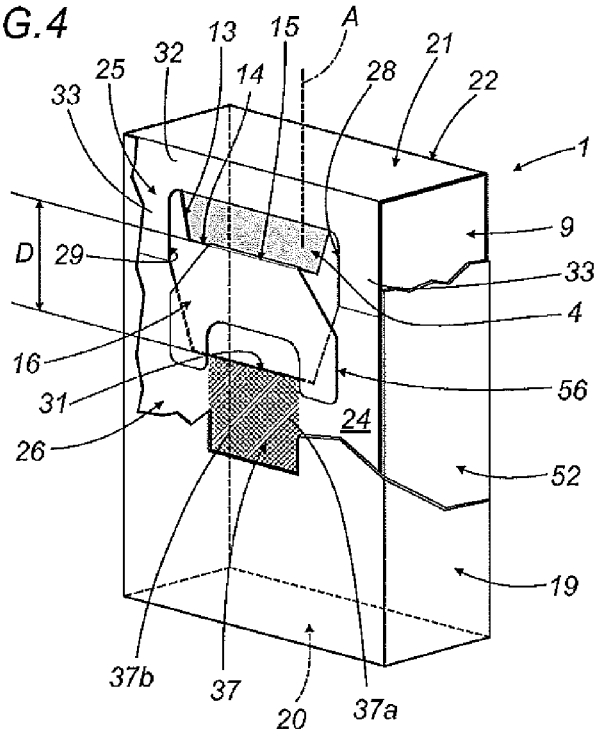
FIGS. 4 and 5 are perspective views of the packet of FIGS. 1 and 2, with some parts cut away in order to better illustrate others.
Figure 5:
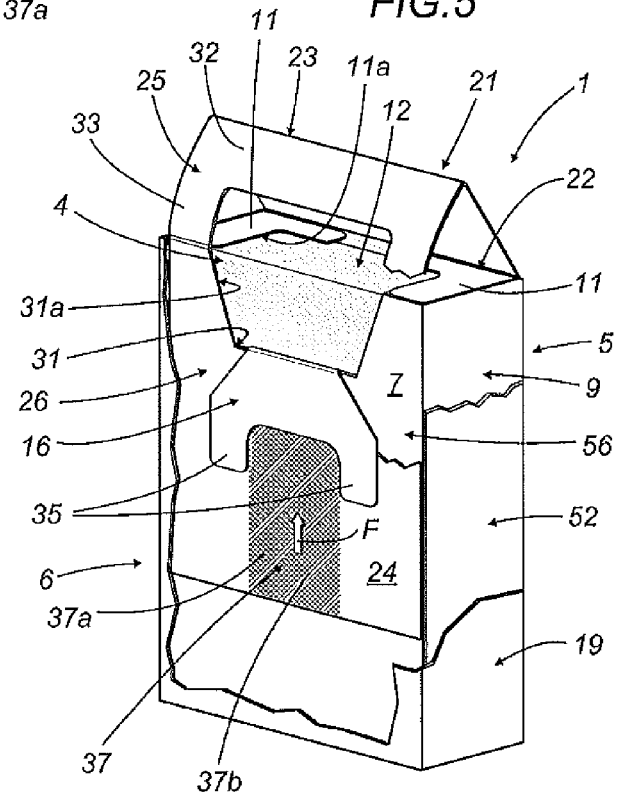
Figure 6:
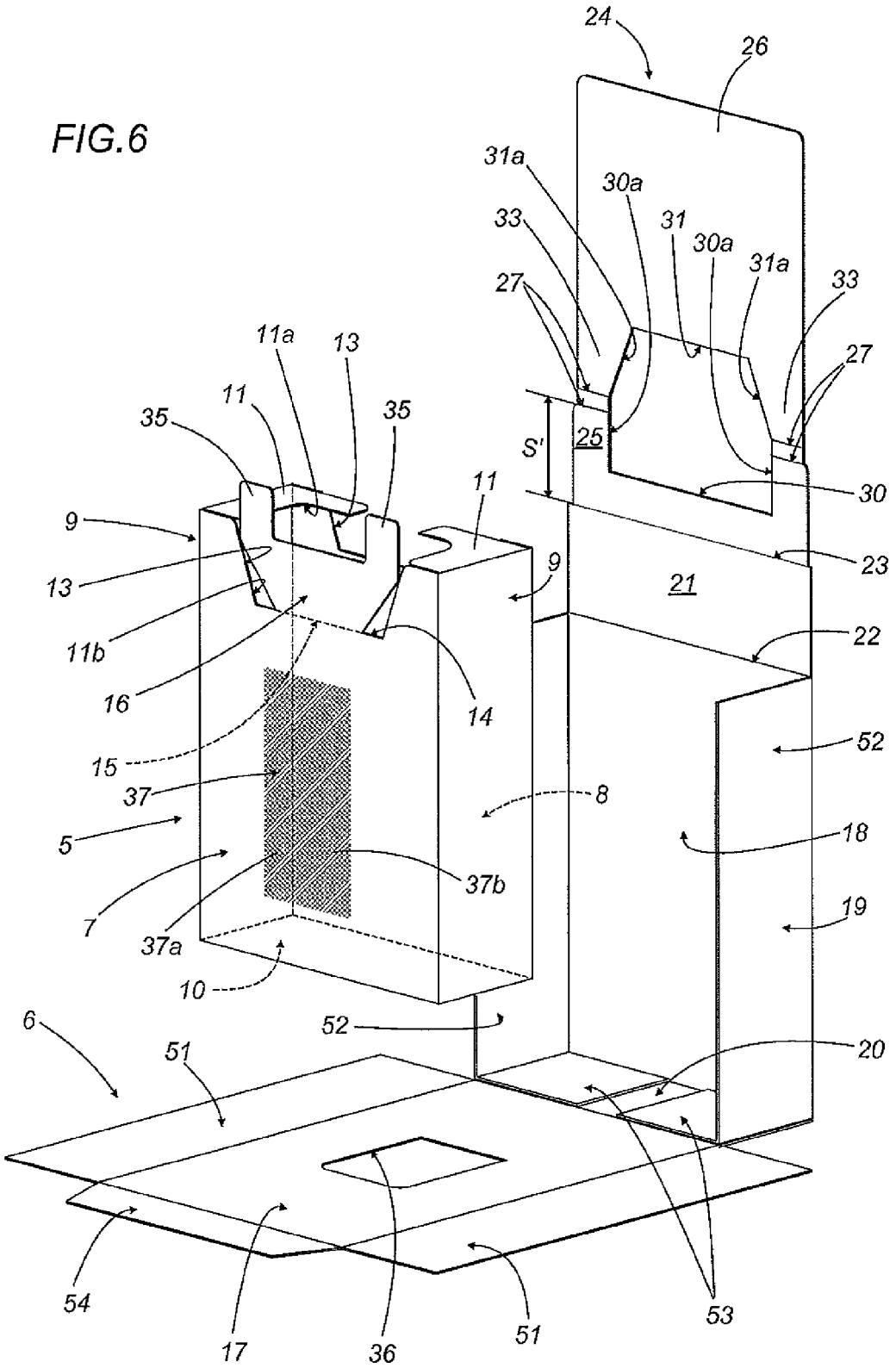
FIG. 6 is an exploded perspective view of the packet illustrated in the preceding figures.

With reference also to FIGS. 4, 5 and 6, the inner case 5, which is in direct contact with the piece of foil 4 wrapped around the group 2, is open at the top and is formed by two larger lateral walls, respectively a front wall 7 and a rear wall 8, by two smaller lateral walls or sides 9 and by a lower wall or base 10 transversal to the axis A.

At the top of it, the inner case 5 has two L-shaped flaps 11 extending from the upper edges of the two sides 9 and defining, between them, an opening labelled 11*a*.

The front wall 7 and the rear wall 8 are defined at the respective upper ends by U-shaped indentations 13 whose concavity is directed towards the upper face 12 of the group 2 and defining respective openings labelled 11*b*.

Further, the bottom edge 14, transversal to the axis A, of the indentation 13 in the front wall 7, has connected to it by a fold line 15, a flap 16, whose function will become clearer as this description continues and which is folded towards the bottom wall 10 and in contact with the outside face of the selfsame front wall 7.

With reference in particular to FIG. 6, the outer case 6 is formed by two larger lateral walls, respectively a front wall 17 and a rear wall or back 18, facing the walls 7 and 8, respectively, and by two smaller lateral walls or sides 19 facing the sides 9 of the inner case 5.

The numeral 20 denotes a bottom wall or base facing the bottom wall 10 of the inner case and the numeral 21 an upper wall or lid connected to the top edge of the rear wall 18 by a crease line or hinge 22.

The top wall 21 has a projection 24 connected to it by a fold line 23 parallel to the fold line 22.

The projection 24 has substantially the same longitudinal and transversal dimensions as the wall 17 and is interposed between the aforesaid front walls 7 and 17 of the cases 5 and 6.

Starting from the fold line 23 the projection 24 has a first panel 25 and a second panel 26 connected by at least one fold line 27.

The fold line 27 is parallel to the fold line 23 and is spaced from the latter by a stretch S' whose length is substantially the same as the thickness, labelled S, of the packet 1.

The projection 24 is provided with a closed indentation 28 forming an opening 29 in the zone connecting the two panels 25 and 26.

The indentation 28 is delimited by a top edge 30 and a bottom edge 31 transversal to the axis A and located inside the panel 25 and the panel 26, respectively.

The portion of the panel 25 between the top edge 30 and the fold line 23 constitutes a front wall, labelled 32, of the lid 21.

Laterally, the opposite edges 30*a* of the opening 29 are parallel to each other in a first stretch, starting from the top edge 30, in such a way as to form two strips 33, and convergent towards the bottom edge 31 in a second stretch 31*a*.

The level of the bottom edge 31 of the opening 29 is a certain length D below the fold line 15 of the flap 16, whose lateral edges converge on each other in the opposite direction to that of the edges 31*a* of the opening 29 (FIG. 4).

Further, with reference to FIGS. 4 and 5, the flap 16, folded outwards and shaped like a fork, is of a size such that the lower ends of its prongs, labelled 35, are inserted through the opening 29, between the front wall 17 of the outer case 6 and the second panel 26 of the protrusion 24.

The central zone of the front wall 17 is provided with a substantially rectangular opening 36 defining on the underlying panel 26 a zone 37 for operating the projection 24 in order to control opening and closing of the lid 21, as will become clearer as this description continues.

The zone 37 of the panel 26 is located at a band 37*a*, running parallel to the axis A and having a high friction coefficient, obtained for example by means of a plurality of slits 37*b* (see FIGS. 4 and 5, in particular).

Figure 7:
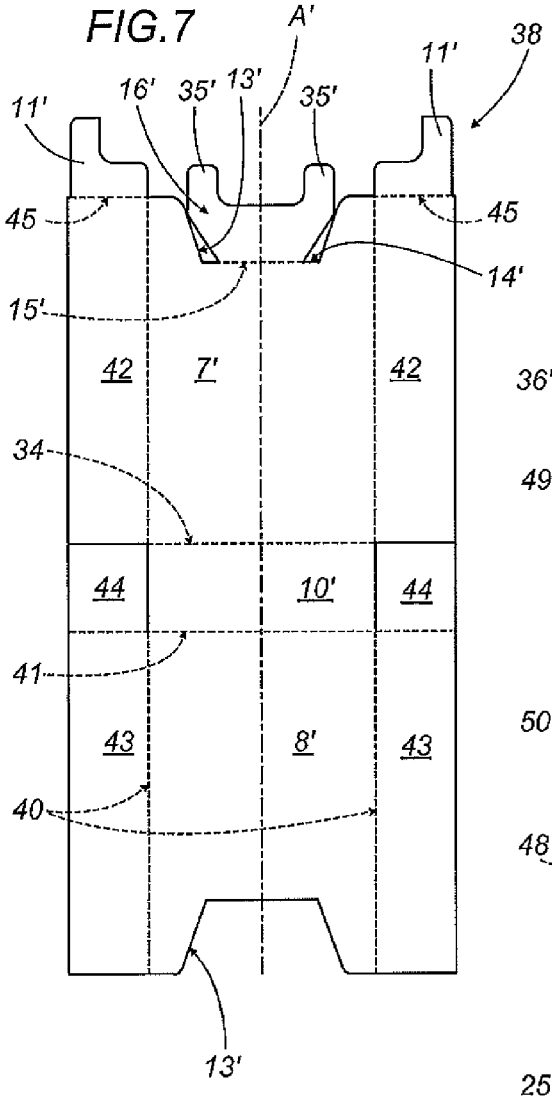
FIGS. 7 and 8 are plan views showing two blanks used to make the packet illustrated in the preceding figures.
Figure 8:
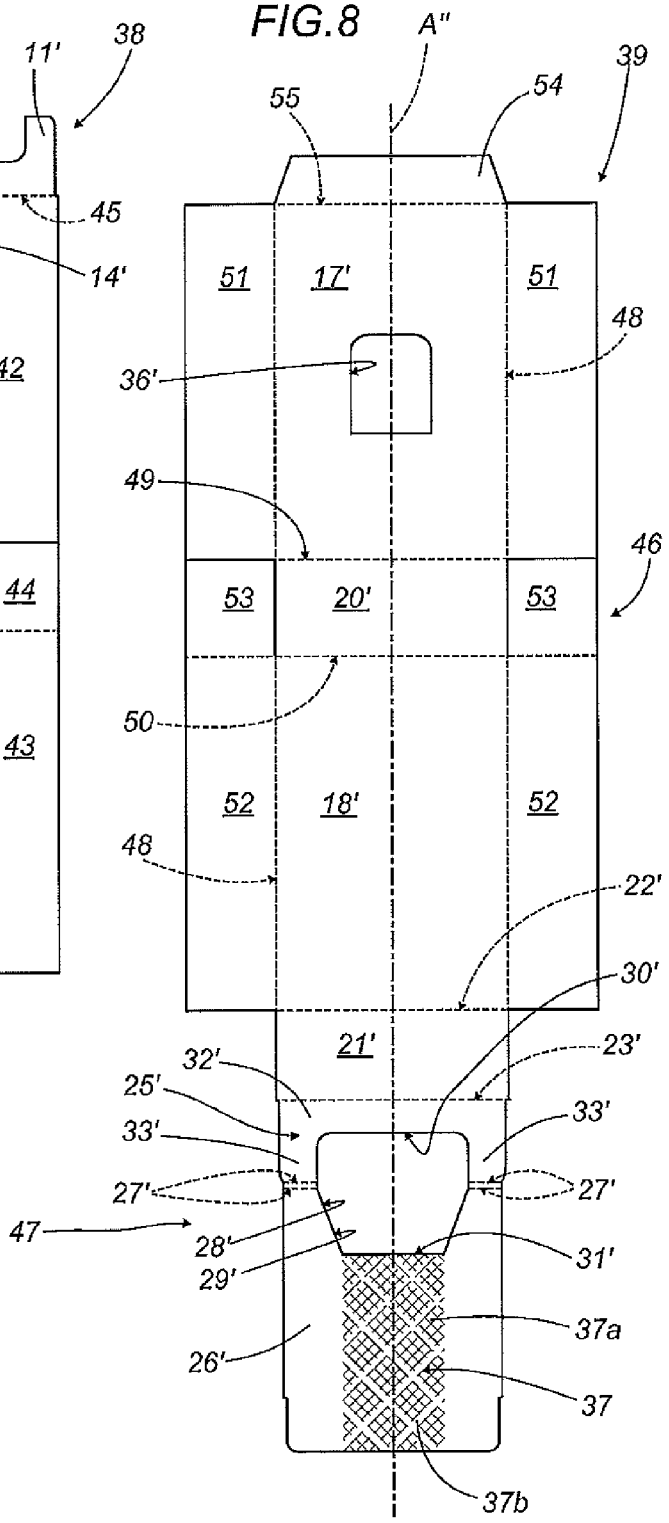

As illustrated in FIGS. 7 and 8, the inner case 5 and the outer case 6 are made from a blank 38 and a blank 39, both of paperboard or similar wrapping material.

Where possible, in the following description of the blanks, the corresponding parts of the packet 1 are denoted by the same reference numerals, distinguished by an index.

The blank 38 of the inner case 5 is substantially rectangular in shape, symmetrical about its longitudinal axis A'. The blank 38 is crossed by two longitudinal fold lines 40 and two transversal fold lines 34 and 41, which form an upper panel 7', a middle panel 10', and a lower panel 8'.

The free ends of the upper panel 7' and of the lower one 8' are defined by U-shaped indentations 13'.

From the bottom edge 14' of the indentation 13' in the upper panel 7', and connected to the selfsame upper panel 7' by a transversal crease line 15', there extends a flap 16', whose upper end has the shape of a fork, with two prongs 35'.

The two longitudinal fold lines 40 define, on the two sides of the upper panel 7' and of the lower panel 8', respective pairs of side flaps, labelled 42 and 43, respectively.

Two tabs 44 are connected by the fold line 41 to the ends of the two flaps 43 directed towards the flaps 42.

Two L-shaped flaps 11' are connected by fold lines 45 to the ends of the two flaps 42 opposite the tabs 44.

The panels 7', 8', 10' form, respectively, the front wall 7, the rear wall 8 and the bottom 10, while the two pairs of flaps 42, 43, once superposed over each other, form the two sides 9.

Lastly, the two tabs 44 will constitute the connecting elements between the bottom 10 and the lateral walls 9 and the two flaps 11' will be positioned at the opening 11*a* of the inner case in contact with the face 12.

As illustrated in FIG. 8, the blank 39 of the outer case 6 is substantially rectangular in shape, symmetrical about its longitudinal axis, labelled A", and comprises a first portion 46 and a second portion 47 connected to each other by a fold line 23' transversal to the axis A".

The first portion 46 is crossed by two longitudinal fold lines 48 and three transversal fold lines 49, 50 and 22', which, from the top down, define a first panel 17', a second panel 20', a third panel 18' and a fourth panel 21', which will constitute, respectively, the front wall 17, the bottom wall 20, the rear wall 18 and the upper end wall 21 of the outer case 6.

The first panel 17' and the third panel 18' have lateral flaps 51 and 52 which, when superposed and fixed to each other by an adhesive substance, labelled G, will constitute the two sides 19 of the outer case 6.

Two tabs 53, which will constitute connecting elements between the bottom 20 and the sides 19 of the outer case 6, are connected by the fold line 50 to the ends of the two flaps 52 directed towards the flaps 51.

The numeral 54 denotes a flap connected to the upper end of the panel 17' by a fold line 55 and designed to be folded into contact with the inside face of the panel 17' to form a reinforcing element for the top edge of the front wall 17.

In its central zone, the panel 17' has a substantially rectangular opening 36'.

The second portion 47, which will constitute the projection 24 of the lid 21, has a longitudinal dimension which is substantially the same as that of the panel 17' and comprises, from the top down, a first panel 25' and a second panel 26', connected to each other by at least one fold line 27'.

The longitudinal dimension of the first panel 25' is substantially the same as that of the panel 21' constituting the upper end wall 21.

The second portion 47 is provided with a closed indentation 28' forming an opening 29' in the zone connecting the two panels 25' and 26'.

The indentation 28' is delimited by a top edge 30' and a bottom edge 31' transversal to the axis A" and located inside the panel 25' and the panel 26', respectively.

Laterally, the opposite edges of the opening 29' are parallel to each other in a first stretch, starting from the top edge 30', in such a way as to form two strips 33', and convergent in the vicinity of the bottom edge 31'.

When the packet 1 is closed, the projection 24 adopts the configuration illustrated in FIG. 4, that is to say, it is fully inserted between the front wall 17 of the outer case 6 and the front wall 7 of the inner case 5, in such a way as to keep the lid 21 in the closed condition.

More in detail, in that condition, the upper end wall 21 is in contact with the upper face 12 of the group 2 and the front wall 32 of the lid 21 is interposed between the front wall 7 and the inner case 5.

When opening the packet 1, the user applies through the opening 36 a pushing action in the direction indicated by the arrow F on the high friction coefficient zone 37 of the panel 26.

The pushing action first causes the panel 26 to slide relative to the front walls 7 and 17 between which the selfsame panel 26 is interposed, thereby partially opening the packet 1 thanks to the rotation of the upper end wall or lid 21 about the defined by the fold line 22.

During the movement of the projection 24, the flap 16 slides freely between the opposite lateral edges of the opening 29.

At the end of this step, when the bottom edge 31 of the indentation 28 comes into contact with the fold line 15, the two strips 33 of the projection 24 extend externally of the cases 5 and 6, while the lid 21 is inclined at an angle of approximately 45° relative to the initial position (FIGS. 2 and 5).

As the pushing action continues, the bottom edge 31 of the indentation 28 engages the fold line 15 of the flap 16, thereby causing the inner case 5 and the group 2 of cigarettes 3 inside it to slide relative to the outer case 6.

The flap 16 and the edge 31 thus constitute mutual engagement means 56 and, more specifically, means for coupling the projection 24 and the front wall 7 of the inner case 5.

Sliding stops when the upper end wall 21, after turning through 90°, adopts a position where it is substantially co-planar with the rear wall 18 and the upper face 12 of the group 2 of cigarettes 3 is substantially in contact with the two strips 33 and with the front wall 32, which thus constitute an external limit stop element for the inner case 5 and the group 2 of cigarettes 3 inside it.

In this condition, the projection 24 is positioned in such a way that the respective opening 29 is located at an opening in the inner case, labelled 57 as a whole, and consisting of the aforesaid opening 11*a*, formed by the L-shaped flaps 11, and the front opening 11*b*, formed by the U-shaped indentation 13.

Consequently, the group 2 protrudes from the outer case 6 by an amount such as to allow the cigarettes 3 to be easily picked from the packet, substantially in the same way as with customary hinge lid packets.

Obviously, to close the packet 1, the user applies through the opening 36 a pushing action in the direction opposite to that indicated by the arrow F on the high friction coefficient zone 37 so that the lid 21 adheres to the face 12 again and the front wall 32 returns between the inside face of the front wall 17 and the inner case 5.

Figure 9:
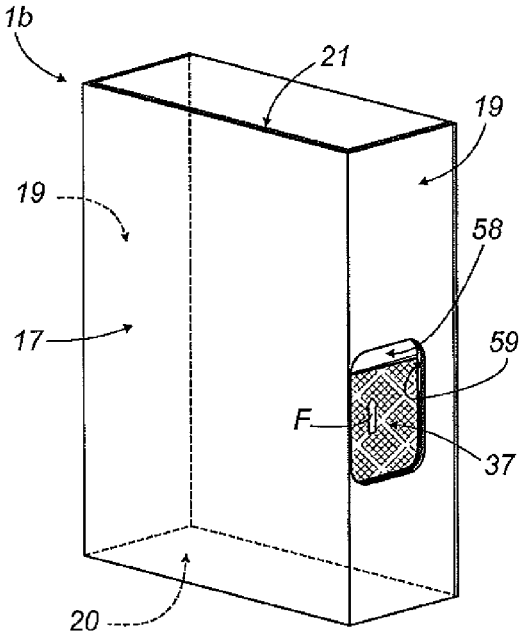
FIG. 9 shows a second embodiment of the packet according to the invention.
Figure 10:
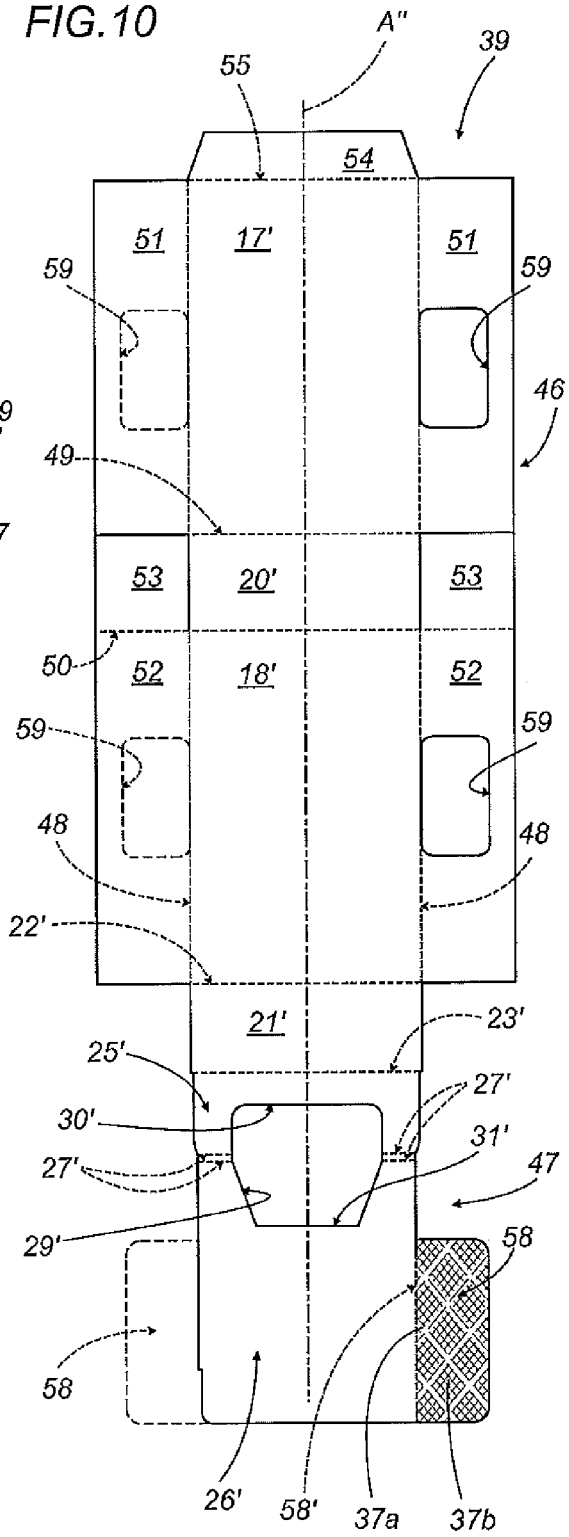
FIG. 10 is a plan view showing the blank used to make the packet of FIG. 9.
Figure 11:
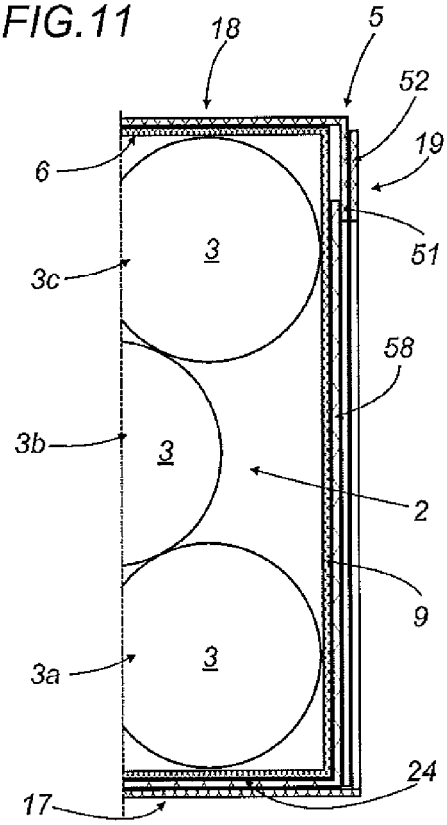
FIG. 11 shows in cross section an enlarged detail from FIG. 9.

FIGS. 9, 10 and 11 show a second embodiment, labelled 1*b*, of the packet 1.

The packet 1*b* differs from the packet 1*a* in that the zone 37 for actuating the projection 24 is not located on the projection itself but on a lateral flap 58 connected to the panel 26 of the projection 24 by a fold line 58'. The flap 58, whose surface has a high friction coefficient thanks to the presence of the slits 37*b*, is accessible through an opening 59 made in one side 19 of the outer case 6. When the packet 1*b* is opened, the flap 58 slides between the wall 19 of the outer case 6 and the lateral wall 9 of the inner case 5.

In a variant of this embodiment, there are two flaps 58 on opposite sides, accessible through respective openings 59 (FIG. 10), instead of a single flap 58.

Figure 12:
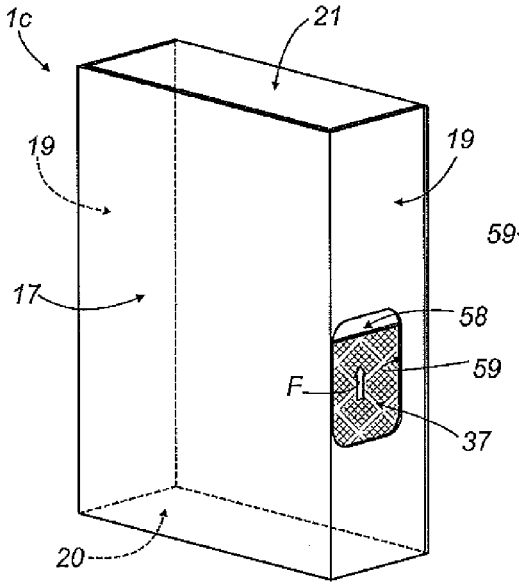
FIG. 12 shows a third embodiment of the packet according to the invention.
Figure 13:
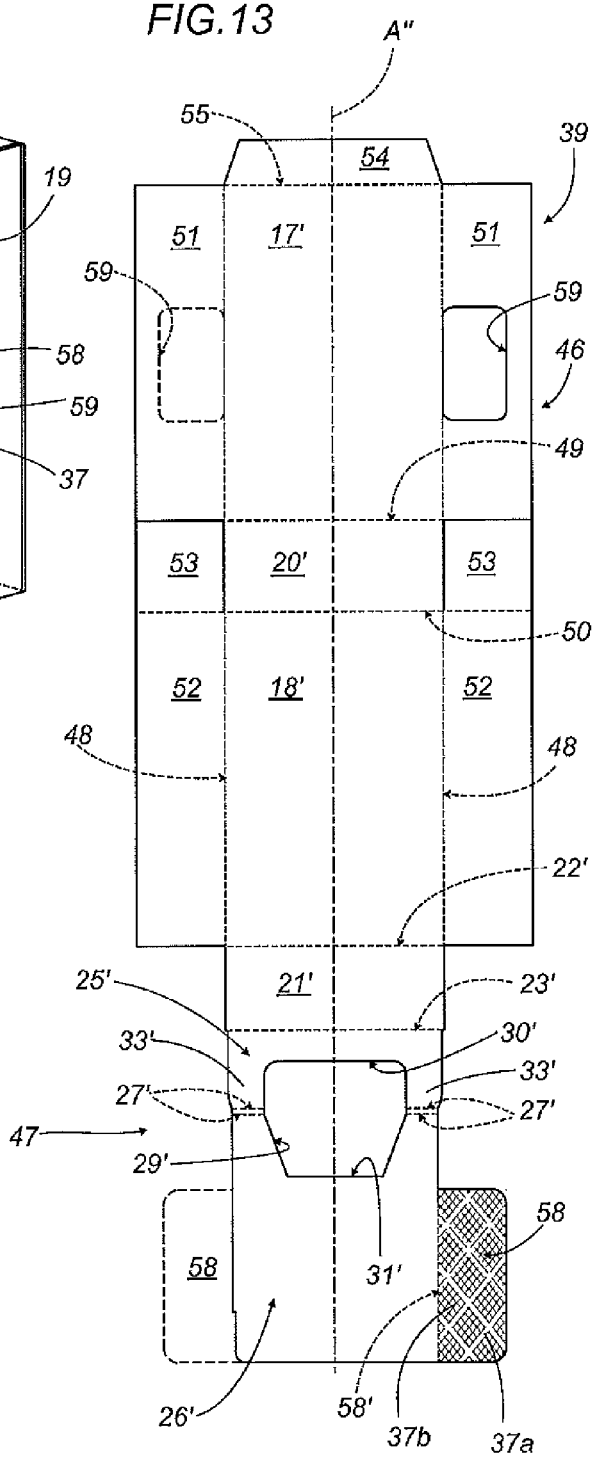
FIG. 13 is a plan view showing the blank used to make the packet of FIG. 12.
Figure 14:
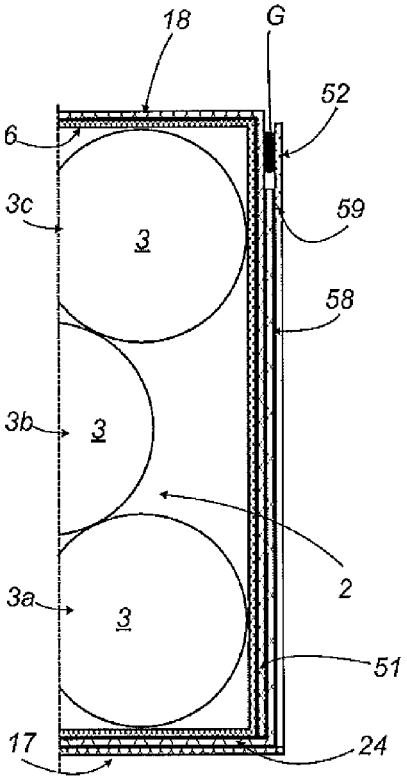
FIG. 14 shows in cross section an enlarged detail from FIG. 12.

A third embodiment of the packet 1 according to the invention is shown in FIGS. 12, 13 and 14.

In this embodiment, the packet 1, labelled 1*c*, differs from the packet 1*b* only in that the flap 58 slides between the two flaps 51, 52 which are superposed over each other to form the lateral wall 19 of the outer case 6. For this reason, the openings 59 are made on only one lateral flap or on both lateral flaps 51.

Obviously, in this case, the adhesive substance G is not applied to the part on which the flap 58 slides.

In this case, too, the variant with two flaps 58 opposite each other is possible.

Figure 15:
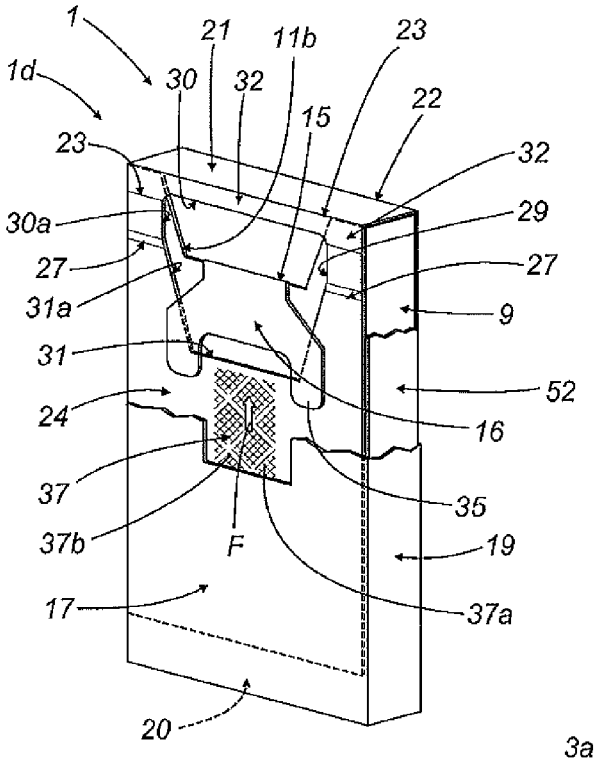
FIGS. 15 and 16 are perspective views showing a further embodiment of the packet according to the invention from two different angles.
Figure 16:
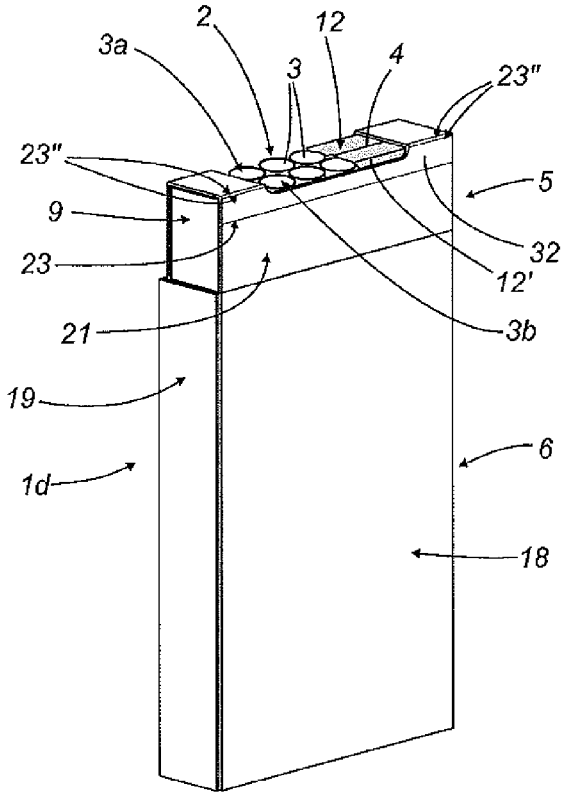

In the embodiment labelled 1*d*, illustrated in FIGS. 15 and 16, the packet according to the invention is thinner than the packets described above because the group 2 consists of only two layers 3*a* and 3*b* of cigarettes 3, instead of three layers.

This embodiment differs from the previous ones in that the distance between the edges 30 and 31 of the opening 29 and the distance, when the packet is closed, between the edge 31 and the fold line 15 are of a size such that the front wall 32 of the lid 21, when the packet is open, is co-planar with the wall 18 instead of in contact with the upper face 12 of the group 2 and the edge 30 substantially coincides with the edge 12' of the group 2 (see FIG. 16).

Figure 17:
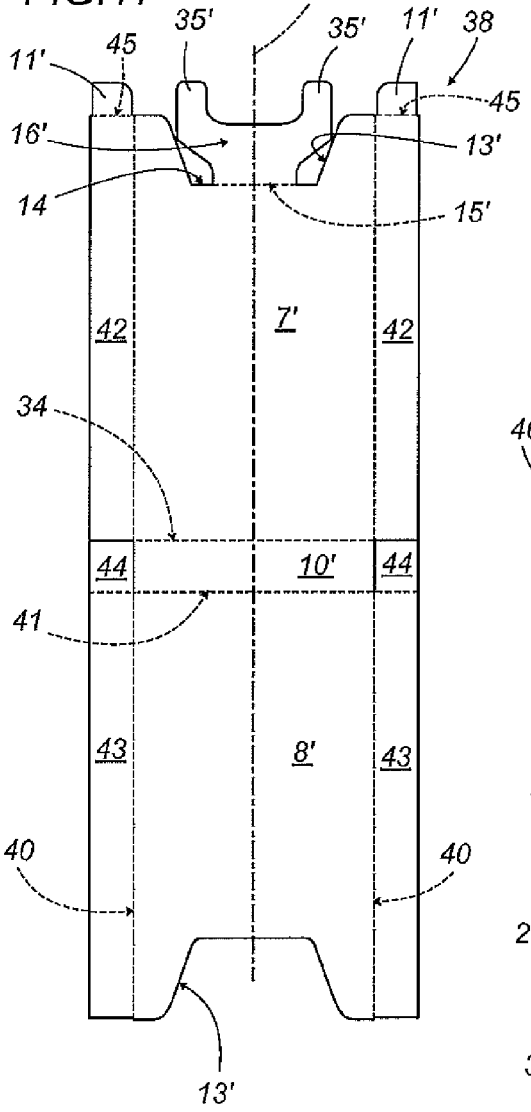
FIGS. 17 and 18 are plan views showing the two blanks used to make the packet of FIGS. 15 and 16.
Figure 18:
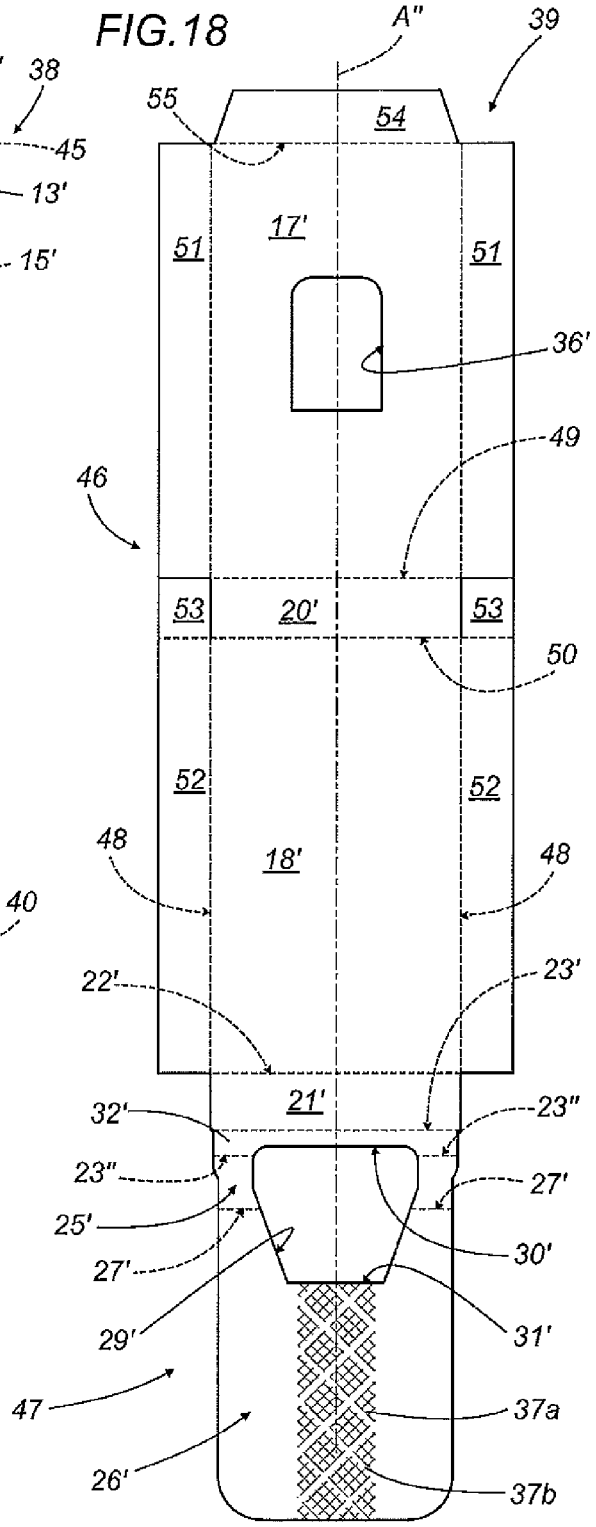

With reference to FIGS. 17 and 18, the reference 23" denotes crease lines parallel to the crease line 23', substantially aligned with the edge 30' of the opening 29' and designed to facilitate folding of the panel 25' at the edge 12'.

It is evident that, in this embodiment, taking out the cigarettes 3 is easier because when the inner case 5 is pushed to its external limit, the upper face 12 of the group 2 is free of the front wall 32 of the lid 21, unlike the packet 1*a*.

Figure 19:
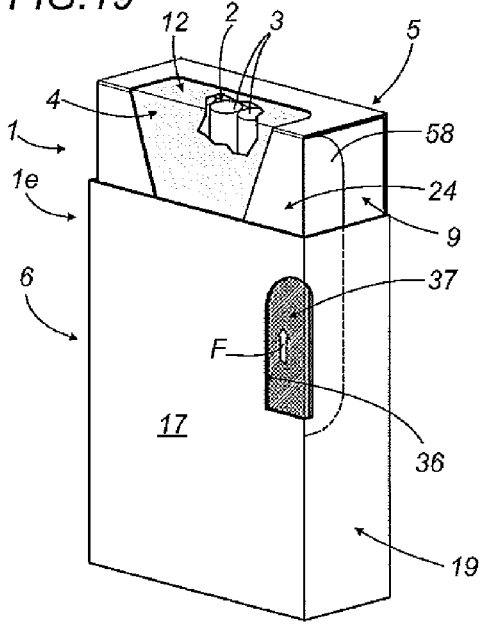
FIG. 19 is a perspective view showing a further embodiment of the packet according to the invention.

The embodiment labelled 1*e*, illustrated in FIG. 19, differs from the embodiment 1*b* of FIG. 9 in that the zone 37 for operating the projection 24 lies partly on the projection 24 and partly on the lateral flap 58.

Figure 21:
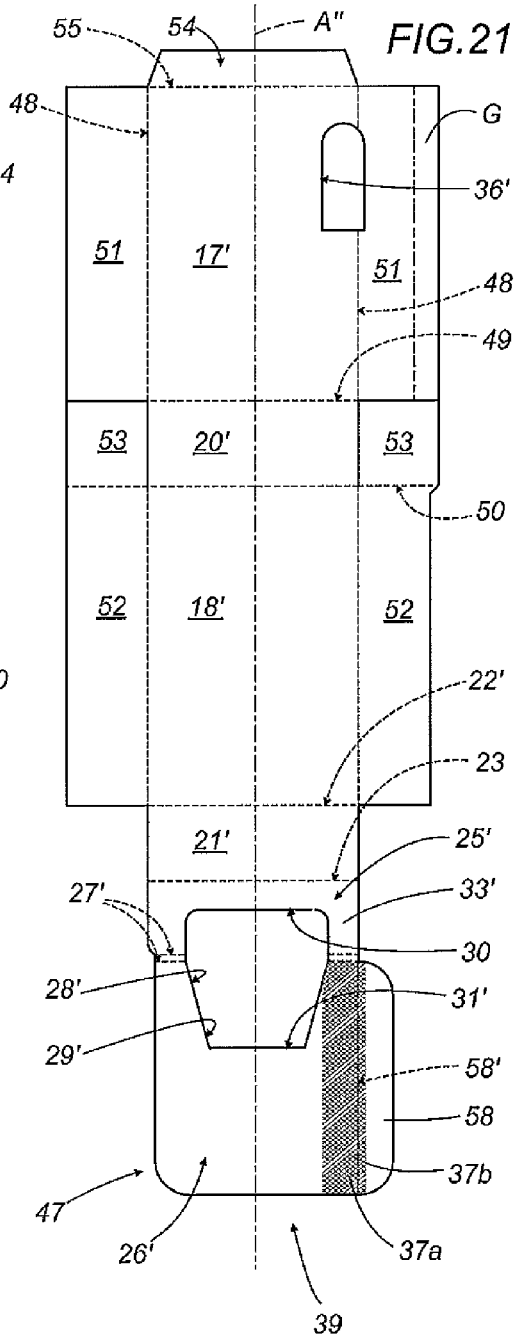

Obviously, in this case, the opening 36 giving access to the operating zone 37 is located, as shown in FIG. 21, at the fold line 58'.

Figure 20:
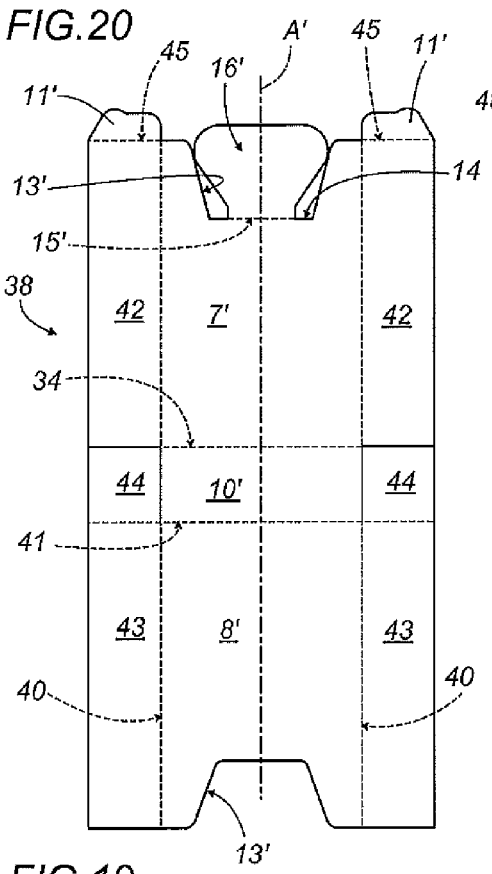
FIGS. 20 and 21 are plan views showing the two blanks used to make the packet of FIG. 19.

It should be noted that in the blank 38 of FIG. 20, relating to the packet embodiment 1*e* of FIG. 19, the flap 16' and the flaps 11' differ in shape from those described above.

Figure 22:
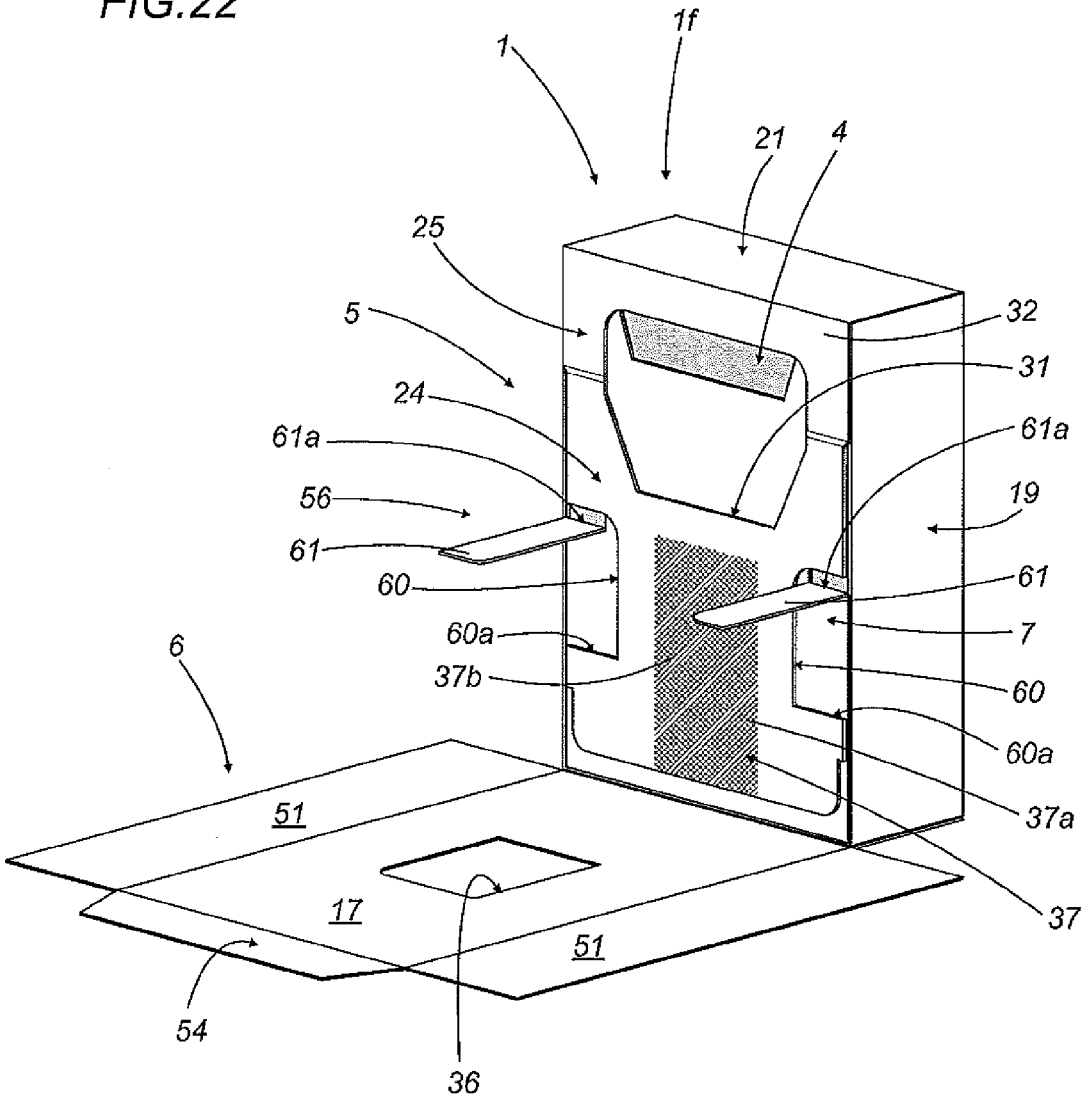
FIG. 22 is a perspective view showing a further embodiment of the packet according to the invention.
Figure 23:
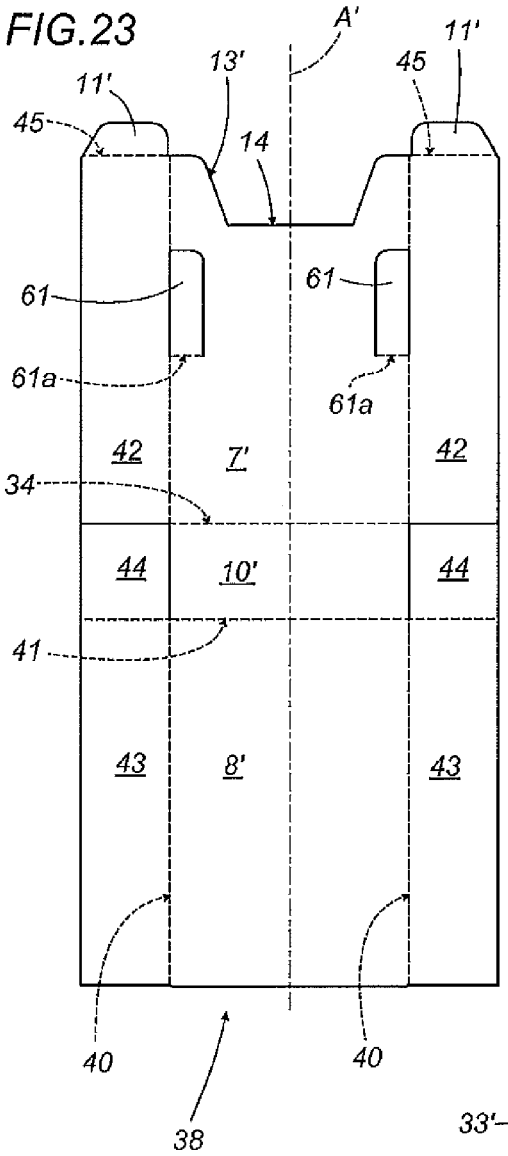
FIGS. 23 and 24 are plan views showing the two blanks used to make the packet of FIG. 22.
Figure 24:
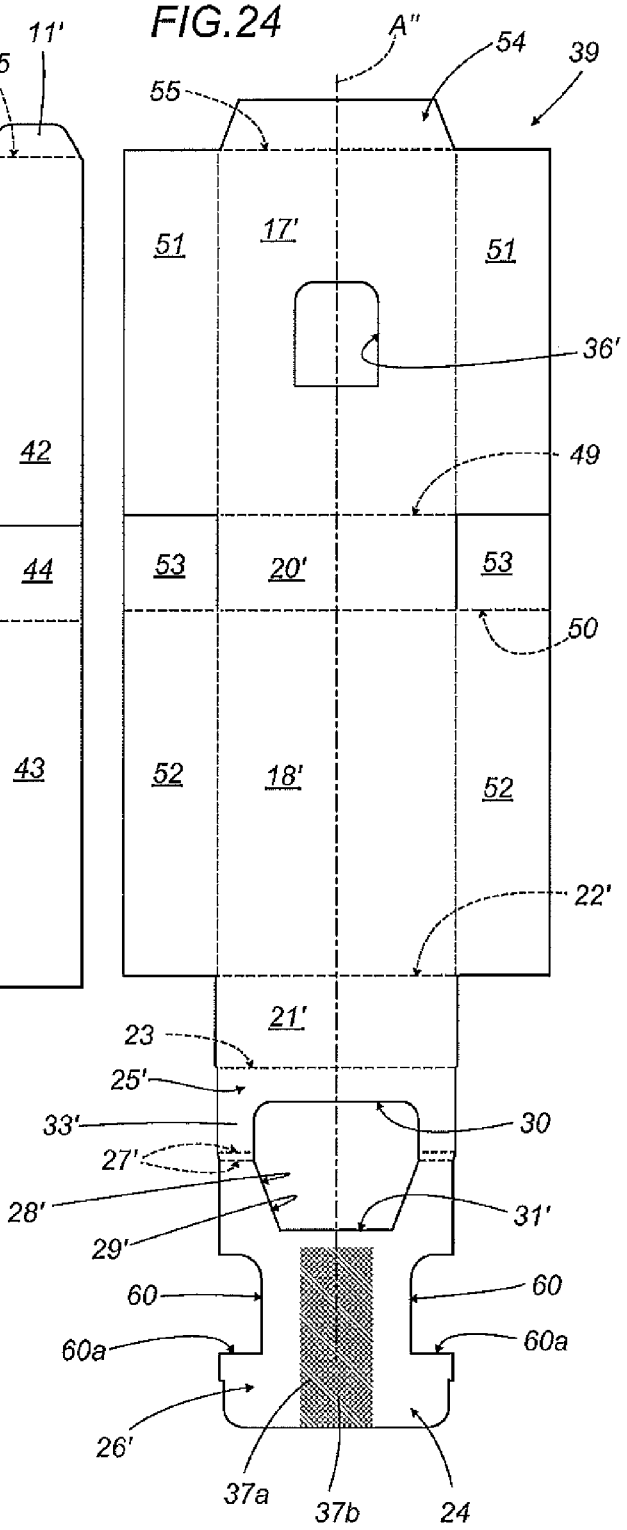

Lastly, the embodiment labelled 1*f*, illustrated in FIGS. 22, 23, 24, differs from the embodiment 1*a* of FIG. 1 in that the mutual engagement means 56 are embodied by the bottom edges 60*a* of two lateral indentations 60 of the projection 24 operating in combination with the fold lines 61*a* of two flaps 61 formed on the front wall 7 of the inner case 5.

In the blank 38 for the inner case 5 of the last embodiment (see FIG. 23), the panel 8' relating to the rear wall 8 does not have the U-shaped indentation 13' present in the preceding embodiments.

From the foregoing description, it is evident that the packet according to this invention guarantees a better seal, when closed, than prior art hinge lid packets since the front wall 32 of the lid 21 is held securely in place between the front wall 17 of the outer case 6 and the front wall 7 of the inner case 5.

The invention claimed is:

1. A cigarette packet substantially having a shape of a parallelepiped, elongate according to an axis, containing a group of cigarettes and comprising:

an outer case formed by two larger lateral walls, respectively a front wall and a rear wall, and by two smaller lateral walls or sides, by a lower wall or base and by an upper wall or lid;

an inner case being inserted in the outer case and formed by two larger lateral walls, respectively a front wall and a rear wall, by two smaller lateral walls or sides, by a lower wall or base and wherein a top part of the inner case includes an opening located at an upper face of the group of cigarettes, wherein the inner case is inserted in the outer case such that the inner case can slide axially, the outer case comprising a projection for controlling the outer case upper wall or lid, the projection being interposed between the front wall of the outer case and the front wall of the inner case and being able to move between a first position in which the outer case upper wall or lid is closed and a second position in which the outer case upper wall or lid is open, and further comprising means for reciprocal engagement of the projection and the inner case, and wherein the outer case upper wall or lid is connected on one side to the outer case rear wall by a hinge line and on an opposite side to the projection by a fold line.

2. The cigarette packet according to claim 1, wherein the projection comprises an opening substantially coinciding with the opening in the inner case in the open position.

3. The cigarette packet according to claim 1, wherein the means for reciprocal engagement comprises means for coupling the projection and the front wall of the inner case.

4. The cigarette packet according to claim 3, wherein the coupling means comprises a fold line of at least one flap of the front wall of the inner case operating in conjunction with an edge of an indentation made in the projection.

5. The cigarette packet according to claim 1, wherein the projection comprises two strips connected to the upper wall or lid of the outer case the two strips delimiting therebetween an opening of the projection, wherein the two strips form, in the open position, elements designed to make contact with the upper face of the group.

6. The cigarette packet according to claim 1, and further comprising at least one zone on the inner case for operating the projection; an opening in the outer case through which the operating zone can be accessed, for controlling lid opening and closing.

7. The cigarette packet according to claim 6, wherein the opening in the outer case is positioned in the front wall of the outer case such that a part of the projection is exposed through the opening in the outer case.

8. The cigarette packet according to claim 6, wherein the opening in the outer case is positioned in at least one of the two smaller lateral walls or sides of the outer case such that a flap which is laterally connected to the projection is exposed through the opening of the outer case.

9. The cigarette packet according to claim 8, wherein the flap is interposed between at least one of the two smaller lateral walls or sides of the outer case and at least one of the two smaller lateral walls or sides of the inner case.

10. The cigarette packet according to claim 8, wherein the flap is interposed between two flaps which form one of the two smaller lateral walls or sides of the outer case.

11. The cigarette packet according to claim 6, wherein the projection comprises at least one lateral flap, the opening in the outer case being made in a position such that an edge formed between a panel of the projection and the lateral flap is exposed through the opening of the outer case.

12. The cigarette packet according to claim 6, wherein the zone for operating the projection includes a zone with a high friction coefficient.

13. The cigarette packet according to claim 1, wherein the projection comprises a portion connected to the upper wall or lid of the outer case by a fold line and forming a wall between the front wall of the inner case and the front wall of the outer case.

14. The cigarette packet according to claim 13, wherein when the upper wall or lid of the outer case is in the open position rotated through 90° from the closed position, the front wall of the upper wall or lid of the outer case is positioned in contact with the upper face of the group.

15. The cigarette packet according to claim 13, wherein when the upper wall or lid of the outer case is in the open position rotated through 90° from the closed position, the upper wall or lid of the outer case is coplanar with the rear wall of the outer case.

16. A cigarette packet substantially having a shape of a parallelepiped, elongate according to an axis, containing a group of cigarettes and comprising:

an outer case formed by two larger lateral walls, respectively a front wall and a rear wall, and by two smaller lateral walls or sides, by a lower wall or base and by an upper wall or lid;

an inner case being inserted in the outer case and formed by two larger lateral walls, respectively a front wall and a rear wall, by two smaller lateral walls or sides, by a lower wall or base and wherein a top part of the inner case includes an opening located at an upper face of the group of cigarettes, wherein the inner case is inserted in the outer case such that the inner case can slide axially, the outer case comprising a projection for controlling the outer case upper wall or lid, the projection being interposed between the front wall of the outer case and the front wall of the inner case and being able to move between a first position in which the outer case upper wall or lid is closed and a second position in which the outer case upper wall or lid is open, and further comprising means for reciprocal engagement of the projection and the inner case, wherein the projection comprises two strips connected to the upper wall or lid of the outer case and delimiting therebetween an opening of the projection, wherein said strips form, in the open position, elements designed to make contact with the upper face of the group.

17. A cigarette packet substantially having a shape of a parallelepiped, elongate according to an axis, containing a group of cigarettes and comprising:

an outer case formed by two larger lateral walls, respectively a front wall and a rear wall, and by two smaller lateral walls or sides, by a lower wall or base and by an upper wall or lid;

an inner case being inserted in the outer case and formed by two larger lateral walls, respectively a front wall and a rear wall, by two smaller lateral walls or sides, by a lower wall or base and wherein a top part of the inner case includes an opening located at an upper face of the group of cigarettes, wherein the inner case is inserted in the outer case such that the inner case can slide axially, the outer case comprising a projection for controlling the outer case upper wall or lid, the projection being interposed between the front wall of the outer case and the front wall of the inner case and being able to move between a first position in which the outer case upper wall or lid is closed and a second position in which the outer case upper wall or lid is open, and further comprising means for reciprocal engagement of the projection and the inner case, and wherein the projection comprises a portion connected to the lid by a fold line and forming a wall between the front wall of the inner case and the front wall of the outer case.

18. The cigarette packet according to claim 17, wherein, when the upper wall or lid of the outer case is in the open position rotated through 90° from the closed position, the front wall of the upper wall or lid of the outer case is positioned in contact with the upper face of the group.

19. The cigarette packet according to claim 17, wherein, when the upper wall or lid of the outer case is in the open position rotated through 90° from the closed position, the upper wall or lid of the outer case is coplanar with the rear wall of the outer case.

* * * * *